US006350187B2

(12) United States Patent
Heijkenskjöld

(10) Patent No.: US 6,350,187 B2
(45) Date of Patent: Feb. 26, 2002

(54) ABRASIVE MACHINE

(75) Inventor: Mats Heijkenskjöld, Lidköping (SE)

(73) Assignee: Lidkoping Machine Tools AB, Lidkoping (SE)

( * ) Notice: Subject to any disclaimer, the term of this patent is extended or adjusted under 35 U.S.C. 154(b) by 0 days.

(21) Appl. No.: 09/754,207

(22) Filed: Jan. 5, 2001

Related U.S. Application Data

(63) Continuation of application No. PCT/SE99/01086, filed on Jun. 17, 1999.

(30) Foreign Application Priority Data

Jul. 10, 1998 (SE) ..... 9802503

(51) Int. Cl.[7] ..... B24B 9/00

(52) U.S. Cl. ..... 451/279; 451/6; 451/8; 451/282; 451/291; 451/400

(58) Field of Search ..... 451/6, 8, 9, 10, 451/279, 282, 291, 400, 49

(56) References Cited

U.S. PATENT DOCUMENTS 4,177,607 A 12/1979 Toda 5,495,988 A * 3/1996 Follese et al.

FOREIGN PATENT DOCUMENTS

EP 0 802 018 10/1997

* cited by examiner

*Primary Examiner*—Timothy V. Eley
*Assistant Examiner*—Willie Berry, Jr.
(74) *Attorney, Agent, or Firm*—Burns, Doane, Swecker & Mathis, L.L.P.

(57) ABSTRACT

An abrasive machine includes a rotatably driven tool, chucking equipment for holding the work pieces and a feeding device for effecting relative displacement between the work piece and the rotatably driven tool. The machine further includes a tubular cylindrical housing, a shaft provided with a recess, a rotatable outer casing peripherally enclosing the housing, and a lid member connected to the casing and extending radially over a first end of the tubular cylindrical housing such that an inner surface of the lid members faces the first end of the housing. The rotatably driven tool includes abrasive material carried on the inner surface of the lid member. The shaft is arranged such that when the shaft executes an angular displacement, the work piece held by the chucking equipment is caused to approach and contact the abrasive material.

8 Claims, 2 Drawing Sheets

ABRASIVE MACHINE

This application is a continuation of International Application Ser. No. PCT/SE99/01086, filed on Jun. 17,1999, which designates the United States, and was published by the International Bureau in English on Jan. 20, 2000.

TECHNICAL FIELD

The present invention relates to an abrasive machine, in particular a grinder for removal of material from an end face of a work piece, the machine comprising a rotatably driven tool, chucking equipment for holding the work piece relative the rotatably driven tool and feeding means for effecting relative displacement between the work piece and the rotatably driven tool.

BACKGROUND OF THE INVENTION

Abrasive machines such as grinding machines, lapping machines, honing machines, milling machines, etc., are known in many slightly different designs and embodiments. It is desirous that the machine be compact and as space-saving as possible. For obtaining good machining results, it is on the other hand important that the co-operating parts of the machine have a high mutual stiffness and low tendencies of vibration. These last-mentioned properties are often obtained by giving the machine a heavy bedding and a sturdy and robust design, and therefore these two requirements are often contradictory to the desires for compactness and space-saving properties.

It is known from Swedish Patent Application Nos.9702587-8 and 9702588-6 to provide abrasive machines which at least partially fulfill the above properties. In both said applications, a machine is provided which comprises a tubular cylindrical housing having a longitudinal cylindrical inner space. The cylindrical inner space has a longitudinal axis which is offset from the longitudinal axis of the housing. A shaft is arranged for angular displacement in the cylindrical inner space and has a recess accommodating a motor which is coupled to a rotatable work head. The work head together with the chucking equipment is arranged to hold and rotate a work piece to be treated. The housing is enclosed by a rotatably driven outer casing, with the casing being firmly connected to a lid member having an opening forming at its inner edge a tool, such as a grinding wheel. When the shaft is angularly displaced, the work head is displaced with the work piece in a path allowing the work piece to approach and contact the inner periphery of the tool.

The construction of the machines disclosed in said patent applications implies that the work piece and the tool are supported in a very stable manner since only very short distances are present between the work piece and the shaft which supports the work piece. Furthermore, the arrangement of the tool along the inner periphery of the lid member also implies that the tool exhibits high stability. As a result, these machines exhibit superior precision compared to conventional machines having long support shafts which are subject to vibration and thermal effects.

The machines according to said Swedish patent applications are designed to be able to grind the outer and inner envelope surfaces respectively of annular work pieces. A need exists, however, for a machine which is capable of removing material from an end face of a work piece.

SUMMARY OF THE INVENTION

It is therefore an object of the present invention to provide an abrasive machine which is capable of removing material from an end face of a work piece, which machine can offer superior precision compared to conventional such machines.

This object is achieved by means of a machine according to claim 1.

Preferred embodiments of the invention are detailed in the dependent claims.

BRIEF DESCRIPTION OF THE DRAWINGS:

The invention will be described in greater detail in the following by way of example only and with reference to embodiments shown in the attached drawings, in which.

DETAILED DESCRIPTION OF PREFERRED EMBODIMENTS

Figure 1:
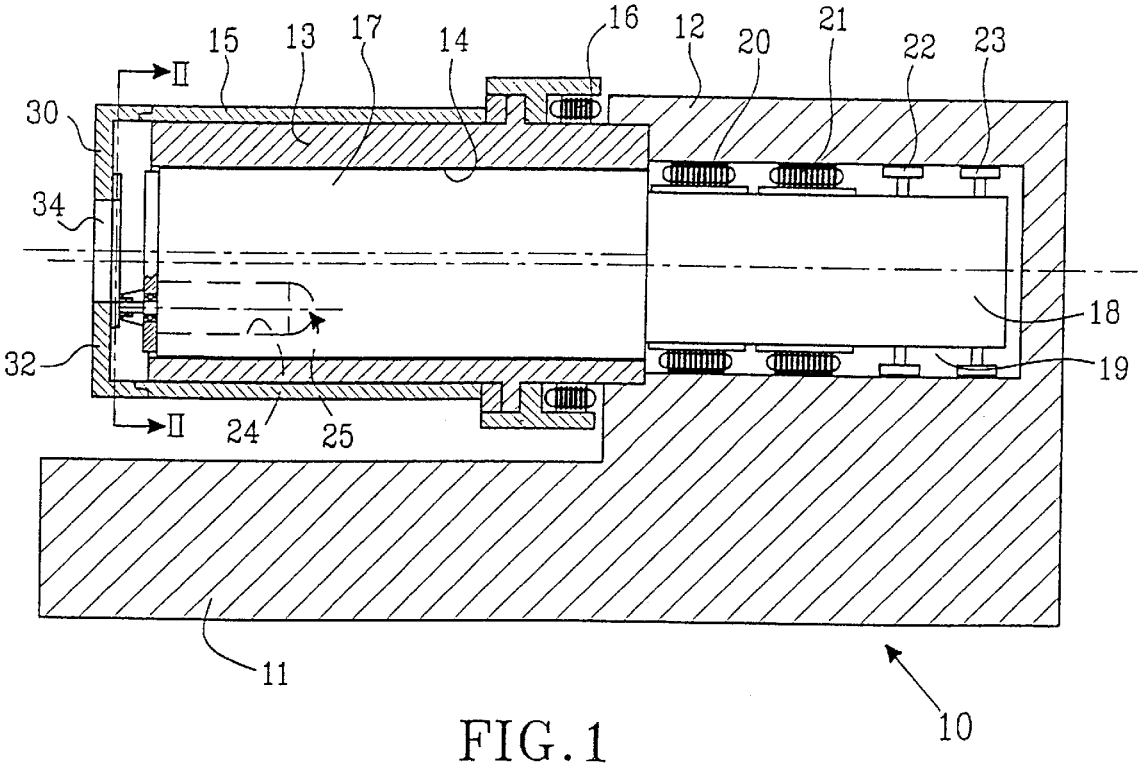
FIG. 1 shows in a schematic longitudinal sectional view an embodiment of the abrasive machine according to the invention.

In the drawings, reference numeral 10 generally denotes an abrasive machine according to the present invention. The machine 10 incorporates a frame 11 which, in the shown embodiment, is designed as a machine bed having, a portion 12 for supporting a cantilever housing. The cantilever housing is designed as an externally cylindrical and substantially tube-shaped elongate housing 13 extending about a longitudinal axis. The housing 13 is provided with a longitudinal cylindrical inner space 14 extending, from a first end of the housing. The cylindrical inner space 14 has a longitudinal axis which is offset from the longitudinal axis of the cylindrical housing 13. The cylindrical housing, 13 is preferably—although not necessarily—non-rotatably connected to the frame 11.

Rotatably supported on the outer envelope surface of the cylindrical housing 13 is a rotatable outer casing 15, a wheel carriage, which is driven by a motor 16, preferably an electric motor, carried by the housing 13. Inside the eccentric inner space 14 of the housing, there is provided a shaft 17 which can be revolved or indexed and displaced axially. In the shown embodiment the shaft 17 has a reduced diameter portion 18 projecting out from the housing inner space 14 in a direction towards the supporting portion 12 of the frame 11. The portion 18 of the shaft thus projecting from the housing is received in a space 19 provided in the portion 12 of the frame 11, and in which space there is provided means for revolving the shaft 17, preferably a torque motor 20, and means for axial displacement of the shaft 17, preferably a linear motor 21. The revolving, and the axial displacement of the shaft is controlled by one or more sensors 22 and 23 respectively, which preferably are also accommodated in the space 19 of the frame portion 12. It is evident that the means for revolving and axially displacing the shaft need not be arranged in a manner as shown in the drawings, but may for instance be contained in a recessed portion of the shaft itself.

At its end opposite the reduced diameter portion 18, the shaft 17 is provided with a recess 24. The recess extends substantially axially into the shaft 17 and is adapted to receive a motor 25, for example an electric motor. The motor 25 is provided with a spindle 26 which projects out of the recess 24. The motor is arranged within the recess such that the spindle 26 extends along, an axis which is non-concentric with the longitudinal axis of the shaft 17.

Chucking, equipment 27 cooperates with the spindle 26 to thereby hold and rotate a work piece 28. The work piece 28 may for example be an inner bearing race ring, though it is to be understood that any work piece having a planar surface which is to be treated can in principle be machined. The actual form of the chucking equipment 27 is of no particular significance and any conventional chuck arrangement which is suitable for clamping the work piece in question may be used, such as centric chucking, micro-centric chucking or magnetic chucking.

Figure 3:
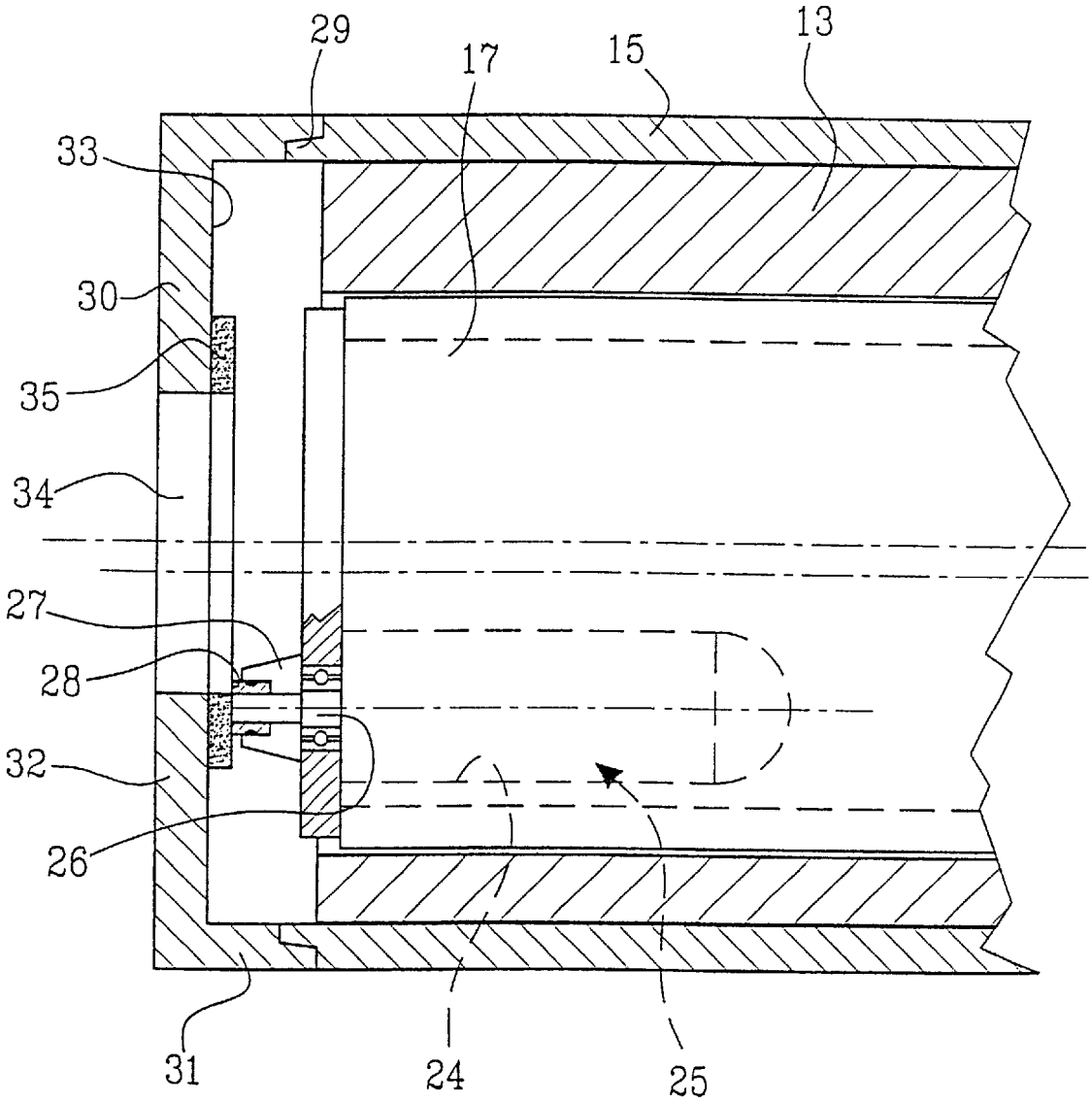
FIG. 3 is a schematic longitudinal sectional view on a greater scale of a part of the abrasive machine of FIG. 1.

As is most clearly apparent from FIG. 3, the rotatable outer casing 15, or wheel carriage, extends axially beyond the first end of the housing 13 and terminates in a peripheral flange 29. A lid member 30 is firmly connected to the outer casing 15 via the peripheral flange 29. The lid member 30 has a substantially cylindrical, axially extending, peripheral wall portion 31 and a substantially flat base portion 32. When the lid member 30 is connected to the outer casing, the base portion 32 extends radially over the first end of the housing 13 such that an inner surface 33 of the base portion 32 of the lid member faces the first end of the housing 13.

The lid member 30 is preferably provided with a central through opening 34 to allow access to the chucking equipment 27 to thereby facilitate mounting and removal of the work piece 28. Alternatively, the lid member 30 may be releasably connected to the outer casing 15 via suitable locking means.

Figure 2:
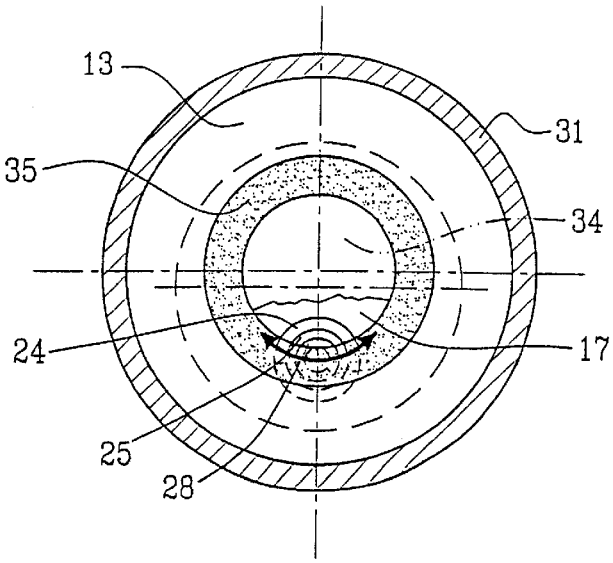
FIG. 2 is a schematic sectional view along line II—II in FIG. 1.

In accordance with the present invention, the lid member 30 is provided with a ring-shaped region 35 of abrasive material on its inner surface 33. The ring-shaped region of abrasive material 35 thus constitutes a rotatably driven tool. In the preferred embodiment in which the lid member 30 is provided with a through opening 34, the ring-shaped region 35 of abrasive material extends radially outwards from the opening. As is most clearly apparent from FIG. 2, the shaft 17 which accommodates the motor 25 is arranged in the inner space 14 of the housing 13 such that when the shaft 17 executes an angular displacement in the inner space, the work piece 28 held by the chucking equipment is caused to approach and contact the ring-shaped region 35 of abrasive material. In this manner, the end face of the work piece can be caused to pass over the ring-shaped region of abrasive material to thereby remove material from the end face. Grinding can also be achieved by displacement of the shaft 17 in the axial direction towards the ring-shaped region 35 of abrasive material.

The abrasive material may be any material which is commonly used for grinding purposes. One example of such material is Cubic Boron Nitride. The abrasive material may be affixed to the inner surface 33 of the lid member 30 by, for example, adhesive means or sintering. The radial extension of the ring-shaped region 35 of abrasive material is preferably at least equal to that of the diameter or radial extension of the work-piece 28. In a typical application, the work-piece may have a diameter of about 30 mm and the ring-shaped region 35 may thus have an inner diameter of about 180 mm and an outer diameter of about 250 mm.

The invention is not limited to the embodiment described above and shown in the drawings. Instead, all modifications and variations within the scope of the appended claims are to be deemed to be covered. For example, the cylindrical housing 13 has been shown having a cylindrical inner space. This space may also have a shape other than a cylindrical shape and the shaft 17 may have any appropriate cross-sectional shape which allows it to be turned or indexed within the inner space of the housing. The portion 18 of the shaft 17 received in the space 19 need not have a reduced diameter. It is further conceivable that the shaft be substituted for a system of articulated links or the like capable of turning or indexing the spindle in an appropriate manner.

What is claimed is:

1. An abrasive machine, in particular a grinder for removal of material from an end face of a work piece, said machine comprising a rotatably driven tool, chucking equipment for holding said work piece relative said rotatably driven tool and feeding means for effecting relative displacement between said work piece and said rotatably driven tool, a tubular cylindrical housing extending about a longitudinal axis, said housing having a longitudinal cylindrical inner space extending from a first end of said housing, said cylindrical inner space having a longitudinal axis which is offset from the longitudinal axis of said housing;

a shaft arranged in said inner space for angular displacement therein, said shaft being provided with a recess;

a motor arranged in said recess;

a spindle coupled to said motor, said spindle cooperating with said chucking equipment to hold and rotate said work-piece;

a rotatable outer casing peripherally enclosing said tubular cylindrical housing;

a lid member connected to said outer casing, said lid member extending radially over said first end of said tubular cylindrical housing such that an inner surface of said lid member faces said first end of said housing, wherein said rotatably driven tool comprises a ring-shaped region of abrasive material carried on said inner surface of said lid member, and said shaft is arranged in said inner space such that when said shaft executes an angular displacement in said inner space, said work piece held by said chucking equipment is caused to approach and contact said ring-shaped region of abrasive material.

2. The machine as claimed in claim 1, wherein said lid member is releasably connected to said outer casing.

3. The machine is claimed in claim 1, wherein said lid member is provided with a central through opening.

4. The machine as claimed in claim 3, wherein said ring-shaped region of abrasive material extends radially outwards from said central through opening.

5. The machine as claimed in claim 1, wherein said shaft has a portion which is rotatably supported in a space in a portion of the frame of the machine, which space accommodates means for rotating said shaft and means for axial displacement of said shaft.

6. The machine as claimed in claim 5, wherein said portion of said shaft which is rotatably supported in said space is of reduced diameter compared to a remainder of the shaft.

7. The machine as claimed in claim 5, wherein said shaft is provided with sensors for controlling rotational and axial displacement of said shaft.

8. The machine as claimed in claim 1, wherein said tubular cylindrical housing is fixedly attached to the frame and said rotatable outer casing is driven by a motor carried by the housing.

* * * * *